United States Patent [19]

Gale

[11] 4,147,395

[45] Apr. 3, 1979

[54] BAR CONSTRUCTION

[75] Inventor: Allen W. Gale, Rocky River, Ohio

[73] Assignee: Production Experts, Inc., Cleveland, Ohio

[21] Appl. No.: 850,954

[22] Filed: Nov. 14, 1977

[51] Int. Cl.[2] ..... A47B 96/14; A47B 96/18

[52] U.S. Cl. ..... 312/140.2; 211/182

[58] Field of Search ..... 312/140.1, 140.2, 140.3, 312/140.4, 195, 6, 257; 108/111, 153; 5/114; 211/182, 183

[56] References Cited

U.S. PATENT DOCUMENTS

| | | | |
|---|---|---|---|
| 250,658 | 4/1907 | Koonce | 312/6 |
| 475,013 | 5/1892 | Hanley | 312/6 |
| 832,625 | 10/1906 | Ryan | 312/6 |
| 1,161,536 | 11/1915 | Sebring | 312/140.1 |
| 1,206,770 | 11/1916 | Adams | 108/111 |
| 1,536,057 | 11/1925 | Williams | 211/182 |
| 2,419,422 | 4/1947 | Schulein | 211/182 |
| 3,246,611 | 4/1966 | Benlian | 108/111 |
| 3,371,797 | 3/1968 | Caligiuri | 211/182 |

FOREIGN PATENT DOCUMENTS

| | | | |
|---|---|---|---|
| 1218839 | 3/1959 | France | 211/182 |
| 617119 | 2/1961 | Italy | 108/153 |
| 347622 | 8/1960 | Switzerland | 312/140.1 |
| 628310 | 8/1949 | United Kingdom | 312/257 A |

*Primary Examiner*—Mervin Stein
*Assistant Examiner*—Alex Grosz
*Attorney, Agent, or Firm*—Isler and Ornstein

[57] ABSTRACT

Bars are disclosed made of a minimum number of strong, readily available materials or parts, which can be manufactured at low cost and easily assembled, even by persons or purchasers of limited mechanical skill or experience, by following simple directions supplied with a carton package containing the parts, in a knock-down condition.

2 Claims, 13 Drawing Figures

BAR CONSTRUCTION

This invention relates, as indicated, to bars, but more particularly to bars designed for use in the home.

A primary object of the invention is to provide a bar of the character described, consisting of a minimum number of strong, readily available materials or parts, which can be manufactured at low cost, and easily and quickly assembled, even by persons or purchasers of limited mechanical skill or experience, by following simple, easily understood directions supplied with the parts, or the cartons or containers in which they are sold.

Another object of the invention is to provide a bar of the character described, embodying a frame which consists principally of tubular members, assembled with conventional type fasteners or fastening means.

A further object of the invention is to provide a bar of the character described, embodying brackets of simple construction for securing tops and shelves of wood, Formica or like materials to the frame.

A still further object of the invention is to provide a bar of the character described, to which expanded metal or other flexible material of a metallic or non-metallic nature, may be applied by means of simple fastening means, to provide a covering for the front and ends of the bar.

Other objects and advantages of my invention will be apparent during the course of the following description.

In the accompanying drawings forming a part of this specification, and in which like numerals are employed to designate like parts throughout the same, FIG. 1 is a top plan view of one form of bar embodying my invention, with a portion of the top broken away to better illustrate the frame structure or construction;

Figure 1:
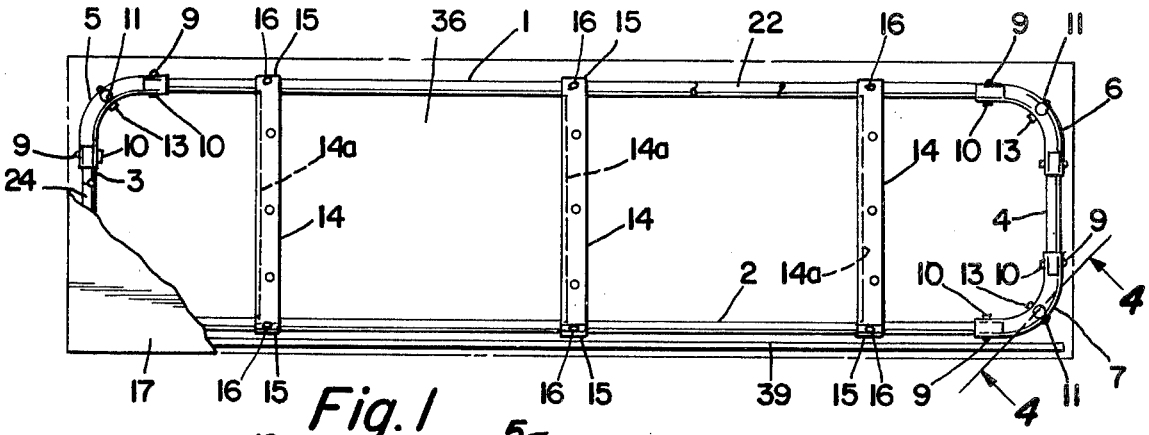

Referring more particularly to FIGS. 1 to 8 inclusive, the bar will be seen to comprise a frame comprising spaced parallel tubular members 1 and 2, short longitudinally-spaced parallel end tubular members 3 and 4, a curved or arcuate tubular corner member 5 interconnecting the members 1 and 3, a member 6, similar to the member 5, interconnecting the members 1 and 4, a member 7, similar to the member 5, interconnecting the members 4 and 2, and a member 8, similar to the member 5, interconnecting the members 2 and 3.

Figure 6:
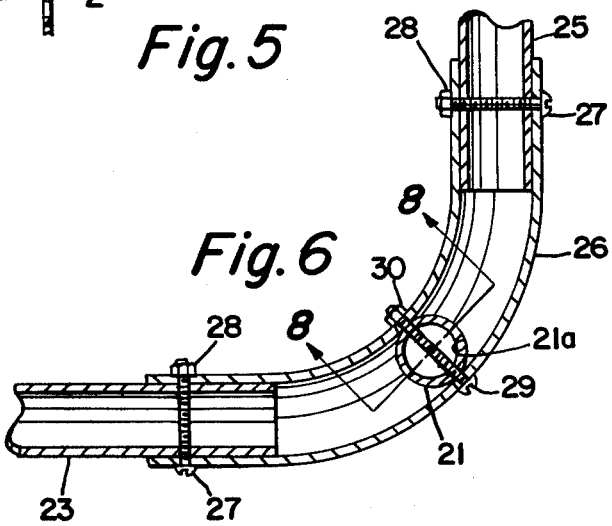
FIG. 6 is a fragmentary cross-sectional view, on an enlarged scale, taken on the line 6—6 of FIG. 2.

The members 1, 2, 3 and 4 are telescoped into the members 5, 6, 7 and 8 in a manner such as indicated in FIG. 6, and maintained in assembled relation with said members by means of bolts 9 and nuts 10.

Figure 4:
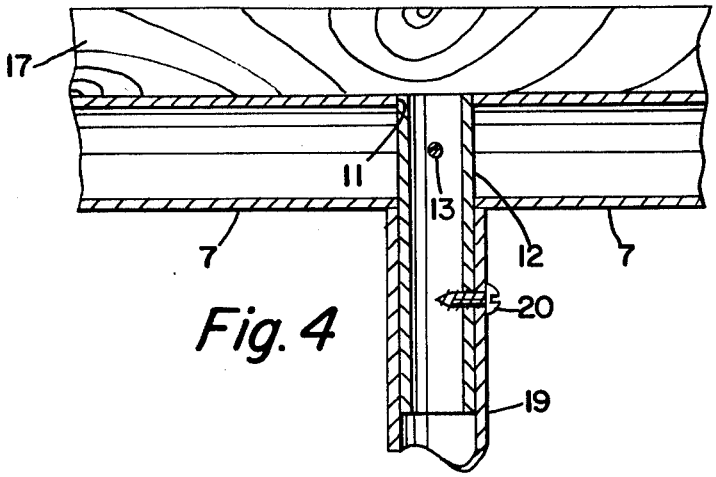
FIG. 4 is a fragmentary cross-sectional view, on an enlarged scale, taken on the line 4—4 of FIG. 1.

As best seen in FIG. 4, each of the members 5, 6, 7 and 8 is provided at its midpoint with an opening 11 extending vertically therethrough, through which a short tubular member 12 extends, and projects below the members 5, 6, 7 and 8. The members 12 are maintained in assembled relation with the members 5, 6, 7 and 8 by means of self-tapping screws 13, similar to the screw 20 shown in FIG. 4.

Figure 2:
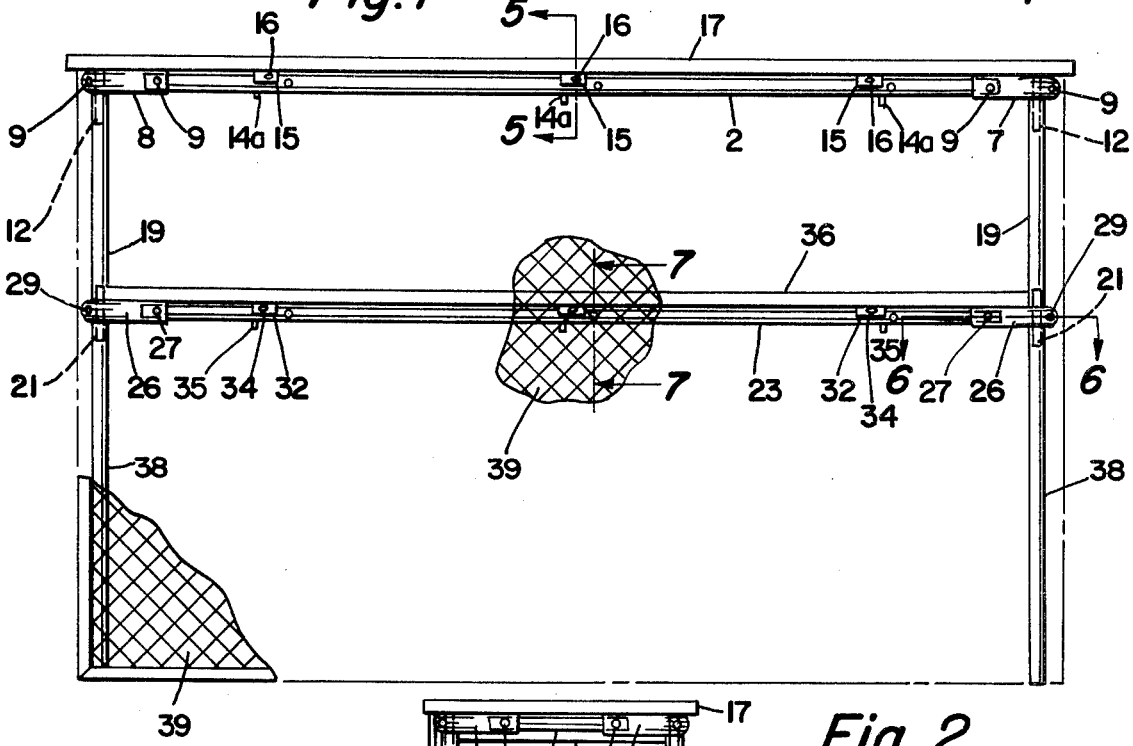
FIG. 2 is a front elevational view of the bar of FIG. 1, with a portion of the expanded metal covering broken away to better reveal the frame structure.
Figure 3:
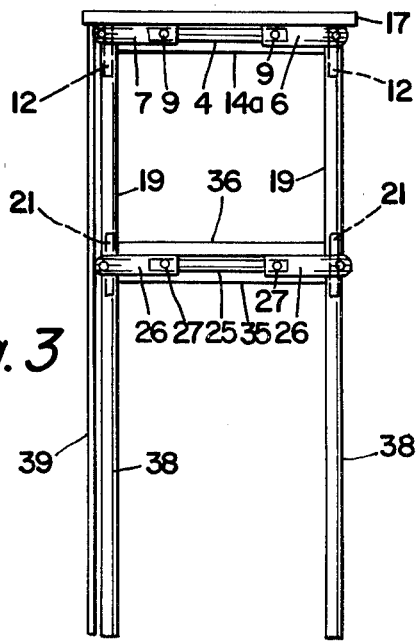
FIG. 3 is a side elevational view of the bar, as viewed from the right side of FIG. 2.
Figure 5:
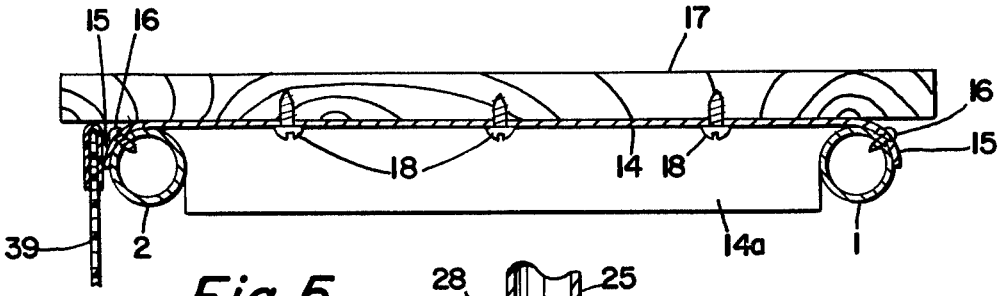
FIG. 5 is a fragmentary cross-sectional view, on an enlarged scale, taken on the line 5—5 of FIG. 2.

As best seen in FIGS. 1, 2 and 5, longitudinally-spaced brackets 14 are provided, which are disposed upon the members 1 and 2 and have curved ends 15 which embrace the members 1 and 2 and are secured to the latter by means of self-tapping screws 16.

Each of the brackets 14 is provided at one edge with a depending flange 14*a* which serves not only to strengthen or rigidify the bracket, but also as a means of maintaining the members 1 and 2 in spaced or spread apart parallel relationship.

The brackets 14 serve as a support for a bar top 17 of wood, Formica or like materials, the bar top being secured to the brackets 14 by means of screws 18 (see FIG. 4).

The frame includes tubular columns 19, which, as best seen in FIGS. 2, 3, 4 and 8, are secured to the member 12 by screws 20, and extend downwardly to tubular members 21, similar to the members 12. The upper portions of the members 21 are telescoped into the lower ends of the columns 19.

The frame further includes a sub-frame comprising tubular members 22, 23, 24 and 25, similar to the members 1, 2, 3 and 4 respectively, these members being disposed below the members 1, 2, 3 and 4, in parallel spaced relation to the latter, and four curved or arcuate tubular corner members 26 similar to the members 5, 6, 7 and 8.

One of the members 26 interconnects the members 22 and 24; another interconnects the members 22 and 25; another interconnects the members 25 and 23, and the fourth interconnects the members 23 and 24.

The members 22, 23, 24 and 25 are telescoped into the members 26 in the manner shown in FIG. 6, and maintained in assembled relation with the members 26 by means of bolts 27 and nuts 28.

Figure 8:
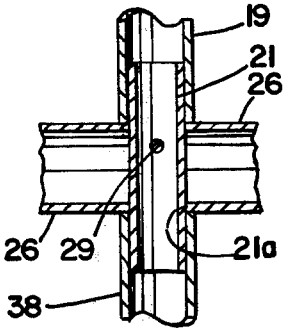
FIG. 8 is a fragmentary cross-sectional view, taken on the line 8—8 of FIG. 6.

As best seen in FIG. 8, each of the members 26 is provided at its mid-point with an opening 21*a* extending vertically therethrough, through which the short tubular member 21 extends, the member 21 having portions projecting above and below the members 26. The members 21 are maintained in assembled relation with the members 26 and by means of bolts 29 and nuts 30.

Figure 7:
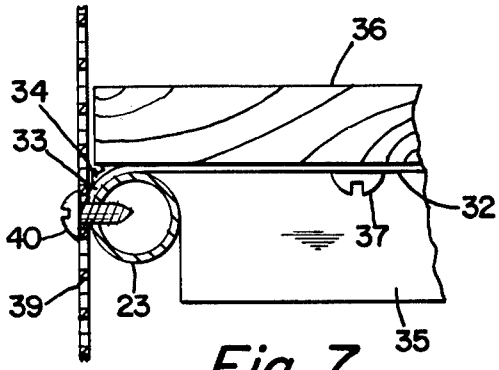
FIG. 7 is a fragmentary cross-sectional view, on an enlarged scale, taken on the line 7—7 of FIG. 2.

As best seen in FIGS. 2 and 7, longitudinally-spaced brackets 32, similar to the brackets 14, are provided, which are disposed upon the members 22 and 23, and have curved ends 33 which embrace the members 22 and 23 and are secured to the latter by means of self-tapping screws 34.

Each of the brackets 32 is provided at one edge with a depending flange 35 which serves not only to strengthen or rigidify the bracket, but also as a means of maintaining the members 22 and 23 in spaced or spread apart parallel relationship.

The brackets 32 serve as a support for a bar shelf 36 of wood, Formica or like materials, the shelf 36 being secured to the brackets 32 by means of screws 37 (see FIG. 7).

The portions of the tubular members 21 which project below the members 26 are telescoped into the upper ends of tubular members 38, which serve as legs or supports for the bar.

For both utilitarian and appearance purposes, the bar may be provided with a covering 39 (see FIGS. 1, 2, 3, 5 and 7), of expanded metal or other flexible material, which may be secured to the frame by means of self-tapping screws 40 or the like.

This covering 39 may be used to cover only the front of the bar, or may be of extended length to cover both the front and ends of the bar.

The bar, as thus constructed, is made of a minimum number of strong, readily available materials which can be manufactured at low cost, and easily and quickly assembled, even by persons or purchasers of limited mechanical skill, by following simple directions, so that the bar may be sold in a knock-down, compact package, containing directions and illustrations for assembly.

Figure 9:
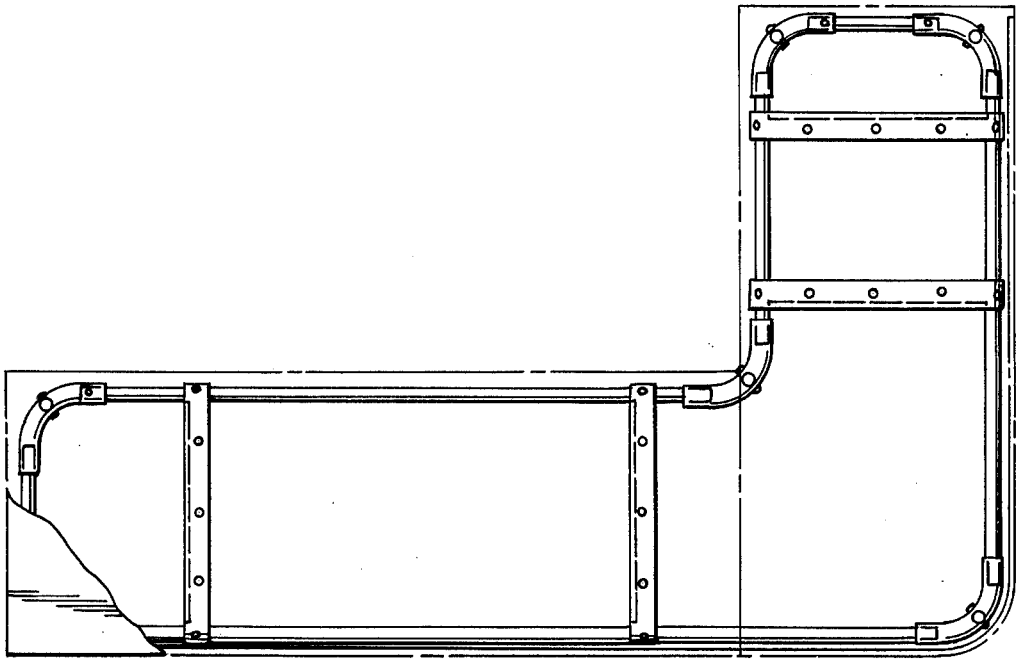
FIG. 9 is a view similar to FIG. 1, but showing a modification of the invention.
Figure 10:
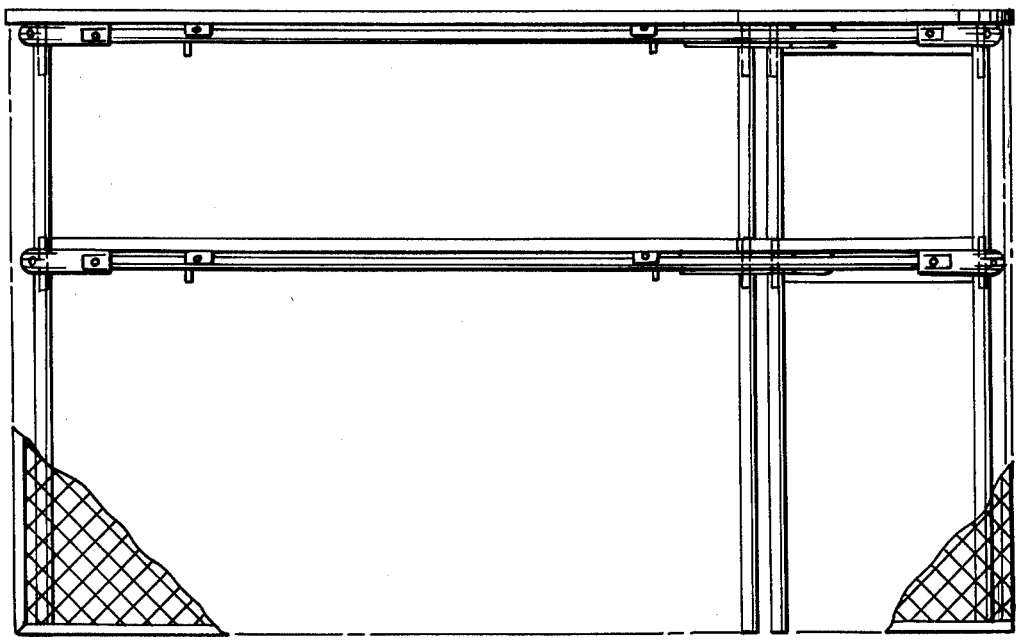
FIG. 10 is a view similar to FIG. 2, but of the modification.
Figure 11:
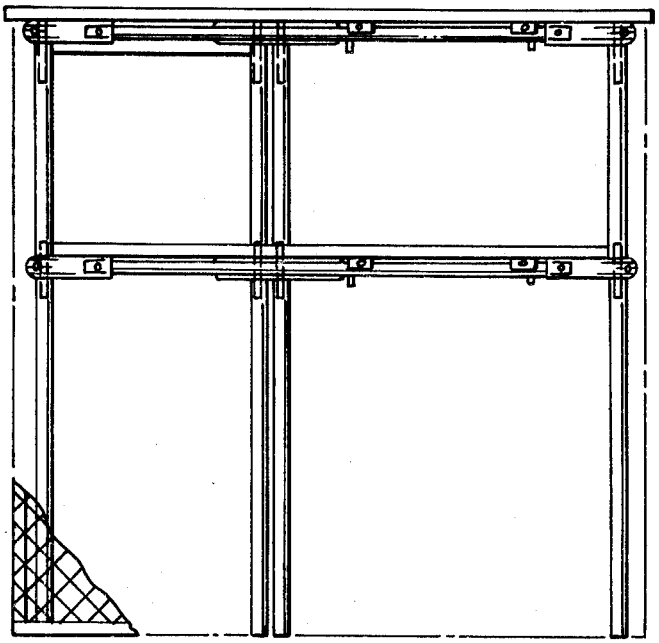
FIG. 11 is a view similar to FIG. 3, but of the modification.

In FIGS. 9, 10 and 11 of the drawings, a modification of the invention is shown in which tubular members, tubular columns, brackets and coverings, similar to those shown in FIGS. 1 to 8 inclusive, are utilized and assembled to provide or form an L-shaped bar.

The construction of the parts and their manner of assembly will be readily understood from an inspection of the drawings, and the above description of FIGS. 1 to 8 inclusive of the drawings.

Figure 12:
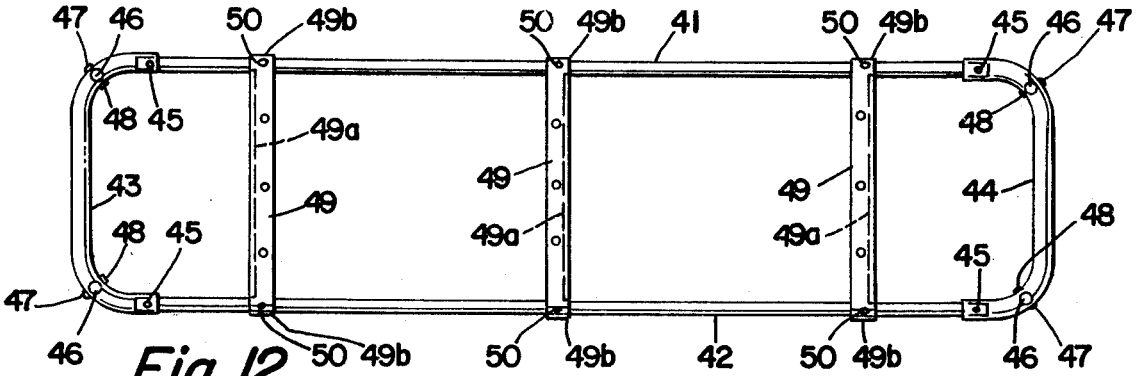
FIG. 12 is a view similar to FIG. 1, but of a modification of the frame of FIG. 1.
Figure 13:
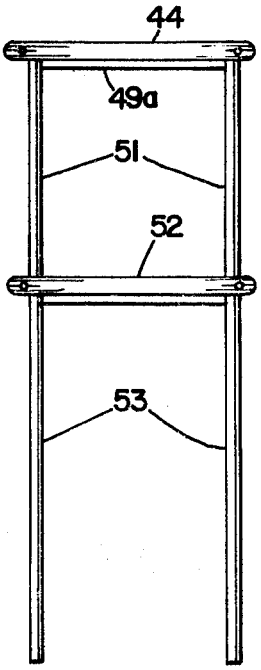
FIG. 13 is a view similar to FIG. 3, but of the frame shown in FIG. 12, as viewed from the right side of FIG. 12.

In FIGS. 12 and 13, another modification is shown, in which the construction of the frame is similar to that in FIGS. 1 to 8 inclusive, with the exception of the ends of the frame.

In this modification, the frame will be seen to comprise spaced parallel tubular members 41 and 42, and tubular end members 43 and 44, which interconnect the members 41 and 42.

The members 43 and 44 are provided with curved end portions into which the ends of the members 41 and 42 are telescoped, and are maintained in assembled relation with the members 41 and 42 by means of bolts 45, and nuts (not shown).

The members 43 and 44 are provided at the mid-points of their curved end portions with openings extending vertically therethrough, through which short tubular members 46 extend, and project below the members 43 and 44. The members 46 are maintained in assembled relation with the members 43 and 44 by means of bolts 47 and nuts 48.

Longitudinally-spaced brackets 49 are provided which are disposed upon the members 41 and 42 and have curved ends **49*b* which embrace the members 41 and 42 and are secured to the latter by means of self-tapping screws 50**.

Each of the brackets 49 is provided at one edge with a depending flange **49*a* which serves not only to strengthen or rigidify the bracket, but also as a means of maintaining the members 41 and 42** in spaced or spread apart parallel relationship.

The brackets 49 serve as a support for a bar top (not shown) similar to the top 17, made of wood, Formica or like materials, the bar top being secured to the brackets 49 by means of screws (not shown) similar to the screws 18.

The frame includes tubular columns 51, which are secured to the members 46 by screws similar to the screws 20, and extend downwardly to tubular members (not shown) similar to the members 21. The upper ends of these members are telescoped into the lower ends of the columns 51.

The frame further includes a sub-frame including tubular members (not shown), similar to the members 41, 42, 43 and 44, these members being disposed below the members 41, 42, 43 and 44, in parallel spaced relation to the latter.

The end members 52 of this sub-frame are provided at the mid-points of their curved end portions with openings extending vertically therethrough, through which short tubular members (not shown), similar to the members 21, extend, these short members projecting above and below the sub-frame.

Longitudinally-spaced brackets (not seen), similar to the brackets 49, are provided, which are disposed upon the longitudinally-extending members of the sub-frame, and have curved ends which embrace these longitudinal members and are secured to the latter by means of self-tapping screws. Each of these longitudinally-spaced brackets is provided at one edge with a depending flange which serves not only to strengthen or rigidify the bracket, but also as a means of maintaining these longitudinally-extending members in spaced parallel or spread apart relationship.

The brackets on this sub-frame serve as a support for a bar shelf (not shown), similar to the shelf 36, and formed of wood, Formica or like materials, the shelf being secured to the brackets by means of screws similar to the screws 37 in FIG. 7.

The portions of the short tubular members which project below the sub-frame are telescoped into the upper ends of tubular members 53, which serve as legs or supports for the bar.

For both utilitarian and appearance purposes, the bar frame of FIGS. 12 and 13 may be provided with a covering similar to the covering 39, of expanded metal or other flexible material, which may be secured to the frame in the same manner as the covering 39.

It is to be understood that the forms of my invention herewith shown and described, are to be taken as preferred examples of the same, and that various changes may be made in the shape, size and arrangement of parts thereof, without departing from the spirit of the invention or the scope of the subjoined claims.

Having thus described my invention, I claim:

1. A rigid, light, portable, and easily assembled multiple frame bar structure made up mostly of tubular members, said bar structure comprising:

(a) horizontally extending straight tubular members;

(b) vertically extending straight tubular members;

(c) a bar top (d) a bar shelf;

(e) straight vertical tubular interconnecting means of a lesser diameter than said vertically extending straight tubular members interconnecting said vertically extending straight tubular members by sliding into said vertically extending straight tubular members;

(f) horizontally extending curved tubular connecting members, said horizontally extending curved tubular connecting members having a greater diameter than said horizontally extending straight tubular members so as to slidably engage said horizontally extending straight tubular members, and said horizontally extending curved tubular members having attaching means fixedly securing said horizontally extending straight tubular members, in addition, said horizontally extending curved tubular members having vertical receiving means receiving said straight vertical tubular interconnecting means;

(g) vertical securing means securing said straight vertical tubular interconnecting means to said horizontally extending curved tubular members;

(h) bracket means including a flat plate having arcuately curved ends for embracing said horizontally extending straight tubular members, said bracket means additionally having a vertical downwardly extending flange, said flange having a substantial vertical width relative to its horizontal width and said flange extending the length of the bracket means and serving to maintain said horizontally extending straight tubular members in spaced relationship and in addition serving to rigidify said bracket means;

(i) bracket attaching means for securing said bracket means in removably fixed relationship to said horizontally extending straight tubular members; and (j) attaching means for removably attaching said bar top to said bracket means which are secured to an upper said frame of the bar, and said bar shelf to said bracket means which are secured to a lower said frame of the bar.

2. In an easily assembled bar structure incorporating a frame having transversely spaced horizontally extending straight tubular members, and means interconnecting the ends of said first-named hollow tubular members including hollow tubular receiving members in which the ends of said first-named hollow tubular members are telescopically received, and means for fastening said hollow tubular members to said hollow tubular receiving members, said tubular members capable of being assembled in diverse forms and resulting in a new bar structure which is more rigid and lighter than previous structures, the improvement comprising; bracket means attached across transversely spaced horizontally extending straight tubular members, said bracket means including a flat plate having arcuately curved ends embracing said transversely spaced horizontally extending straight tubular members, said bracket means additionally having a vertically extending flange in the downward direction, said flange having a substantial vertical width relative to its horizontal width and said flange extending the length of the bracket means and serving to maintain said transverse horizontally extending straight tubular members in spaced relationship, said bracket means additionally having securing means for securing said brackets to said transverse horizontally extending straight tubular members and having attaching means for removably attaching a bar top to the bracket means secured to the upper frame transverse horizontally extending straight tubular members, and a bar shelf removably attached to the bracket means secured to the lower frame transverse horizontally extending straight tubular members.

* * * * *